United States Patent [19]

Sesser

[11] Patent Number: 4,566,632

[45] Date of Patent: Jan. 28, 1986

[54] STEP-BY-STEP ROTARY SPRINKLER HEAD WITH IMPROVED STREAM DIFFUSING ASSEMBLY

[75] Inventor: George L. Sesser, Walla Walla, Wash.

[73] Assignee: Nelson Irrigation Corporation, Walla Walla, Wash.

[21] Appl. No.: 492,031

[22] Filed: May 5, 1983

[51] Int. Cl.[4] ..... B05B 3/08

[52] U.S. Cl. ..... 239/230; 239/233; 239/513

[58] Field of Search ..... 239/230–233, 239/500, 505, 513, 516, 50, 522, DIG.1

[56] References Cited

U.S. PATENT DOCUMENTS

| | | | |
|---|---|---|---|
| 157,353 | 12/1874 | Shafer | 239/505 |
| 1,716,305 | 6/1929 | Dillman | 239/231 |
| 2,654,635 | 10/1953 | Lazzarini | 299/18 |
| 2,801,882 | 8/1957 | Schwemlein | 299/136 |
| 2,841,442 | 7/1958 | Skipwith | 239/513 |
| 3,070,314 | 12/1962 | Warren | 239/230 |
| 3,388,868 | 6/1968 | Watson et al. | 239/427 |
| 3,669,353 | 6/1972 | Hanson et al. | 239/177 |
| 3,744,720 | 7/1973 | Meyer | 239/231 |
| 3,765,608 | 10/1973 | Lockwood | 239/230 |
| 3,837,576 | 9/1974 | Rosenkranz | 239/230 |
| 4,153,202 | 5/1979 | Meyer | 239/230 |
| 4,484,709 | 11/1984 | Hosie | 239/231 |

*Primary Examiner*—Andres Kashnikow
*Assistant Examiner*—James R. Moon, Jr.
*Attorney, Agent, or Firm*—Cushman, Darby & Cushman

[57] ABSTRACT

A step-by-step rotary sprinkler head comprising a sprinkler body having an inlet and at least one outlet communicating with the inlet, a mounting assembly supporting the sprinkler body for rotational movement about a generally vertical axis operable to communicate the inlet of the sprinkler body with a source of water under pressure, a nozzle in the outlet for directing water under pressure communicated with the inlet outwardly of the nozzle in a cylindrical water stream flowing in an upward and outward direction, a drive spoon arm assembly mounted for rotational movement with the sprinkler body and for cyclical movements with respect thereto between a position of stream engagement and a spaced position out of stream engagement for effecting step-by-step rotational movement of the sprinkler body in conjunction with the cyclical movements, and a stream diffusing assembly disposed outwardly of the position of stream engagement of the drive spoon for engaging the cylindrical water stream when the latter is out of stream engagement and diffusing the cylindrical water stream into a fan-shaped spray which is fanned out in a generally horizontal direction, the stream diffusing assembly including upper and lower plates, the lower one of which includes an upwardly and inwardly facing stream engaging surface disposed in a position to engage a lower portion of the cylindrical water stream so that the fan-shaped spray flows in an upwardly and outwardly extending direction after disengagement therefrom.

9 Claims, 4 Drawing Figures

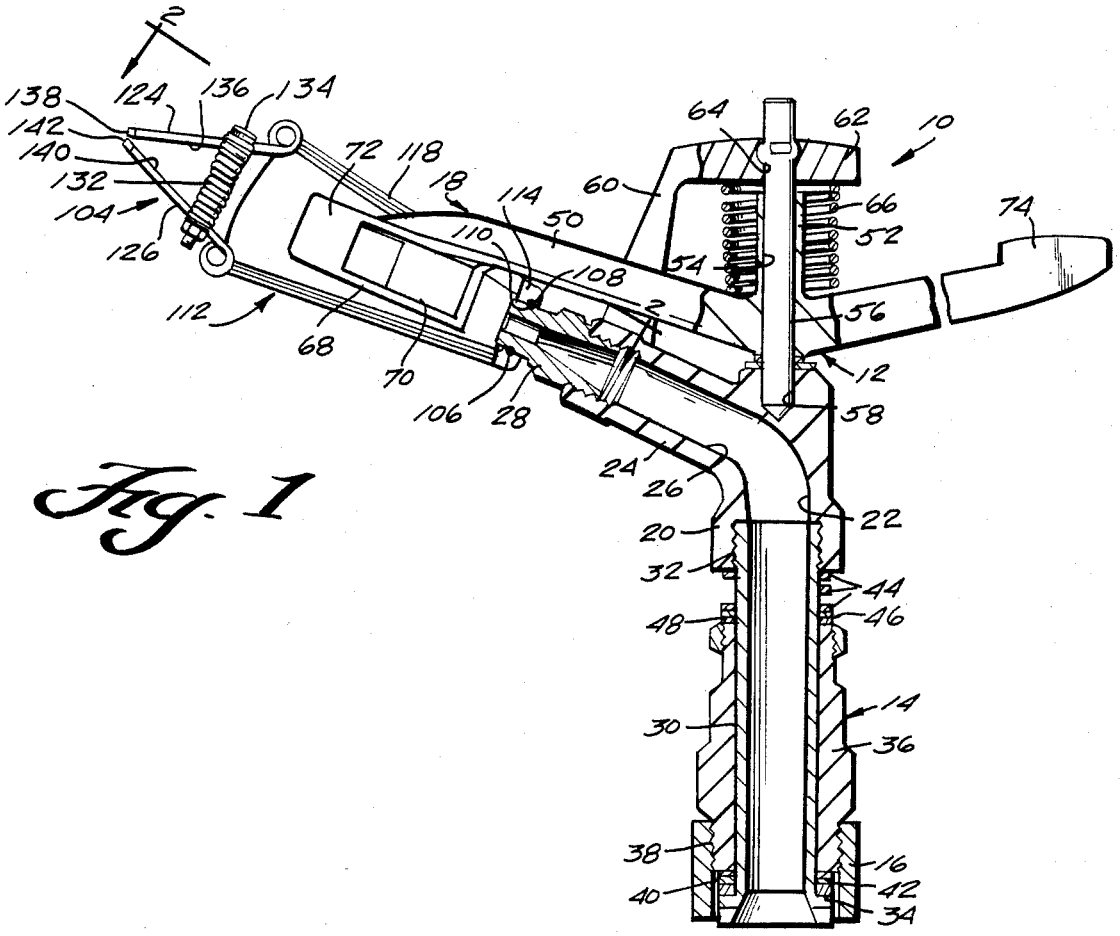
Fig. 1
Fig. 2
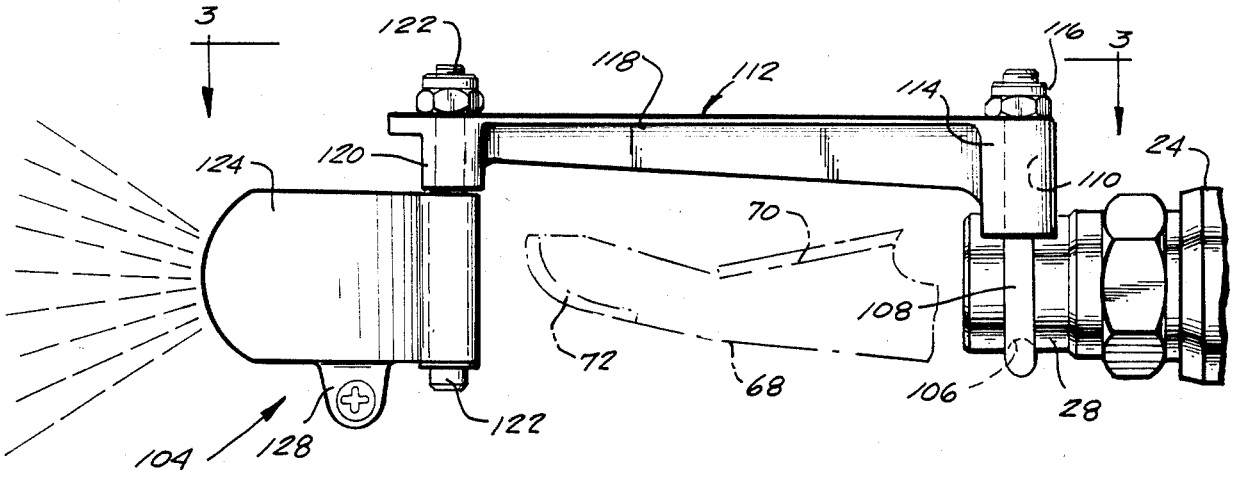

STEP-BY-STEP ROTARY SPRINKLER HEAD WITH IMPROVED STREAM DIFFUSING ASSEMBLY

This invention relates to water sprinklers and more particularly to improvements in step-by-step rotary sprinkler heads of the type utilized in agricultural sprinkler irrigation systems.

The increasing costs of energy and decreasing supply of water have resulted in the desirability of operating agricultural sprinkler irrigation systems with lower pressures. Conventional step-by-step rotary impact sprinkler heads have been used over the years primarily as a high pressure device for distributing a given quantity of water over the greatest possible ground pattern area. The step-by-step rotary sprinkler heads herein contemplated are those known in the art both as impact types and impulse types. Both have the characteristic that the energy of the stream is utilized to effect the oscillatory cycles of the spoon carrying arm which, in turn, effects the step-by-step movement (either by return impact or by water pressure impulses). Both achieve distribution in the area close to the sprinkler head by dispersing the stream through engagement of the spoon therewith and both rely upon an uninterrupted projection of the stream through the air in order to cover the outer reaches of the flow pattern.

The operation of step-by-step rotary sprinkler heads under relatively high pressures is desirable and essential for two reasons. First, a relatively high pressure level is required to cause the oscillating spoon carrying arm to properly cycle. Second, a relatively high pressure is required to project the uninterrupted water stream through the air with sufficient velocity that it will be broken up into relatively fine droplets as it moves along. When efforts are made to operate step-by-step sprinkler heads at relatively lower operating pressures, malfunctions appear in the two areas noted above which require high pressure operation, that is, (1) the energy level becomes insufficient to properly cycle the spoon carrying arm and/or (2) the uninterrupted stream has insufficient velocity energy to break up into small particles but instead falls to the ground in relatively large drops of a size sufficient to cause soil damage, particularly in situations where very young crops are in the field.

In the case of low capacity impact type sprinkler heads, one solution to the above-noted problems which are presented as a result of lower pressure operation has been to provide a modified nozzle construction which serves to discharge the water from the sprinkler head outlet at lower pressures in a controlled dispersed condition, the arrangement being such that substantially all of the energy in the dispersed stream can be directed onto the drive spoon to cycle the same while at the same time, when the spoon is not intercepting the stream, the stream will be diffused and divided up into droplets of a size which are not damaging. One embodiment of a nozzle construction of this type is disclosed in commonly assigned U.S. Pat. No. 4,364,519. Other arrangements of this type have not proven to be entirely satisfactory on the higher capacity sprinkler heads, particularly those of the impulse type, for one or more of the following reasons. (1) Energy is dissipated in diffusing the stream and hence less energy is available to effect the oscillatory movements of the spoon carrying arm. (2) A diffused stream cannot be fully directed onto the spoon to the same concentrated effect that a cylindrical stream can, thus further reducing the energy available to effect the oscillatory movements of the spoon carrying arm. (3) Diffusion-type nozzles inherently have at least one dimension which is smaller than comparable dimensions of a round nozzle outlet and these smaller passages are more likely to plug. (4) The smaller passage areas of diffusion-type nozzles are subject to more rapid wear with a resultant greater percentage increase in the flow rates allowed to pass therethrough as wear progresses. Where higher capacity sprinkler heads are utilized, it has been found to be much more desirable to retain the cylindrical nature and integrity of the stream issuing from the outlet so as to utilize the maximum amount of energy available in effecting the cycling of the oscillating arm. By maintaining the integrity of the stream, the limiting factor in operating the sprinkler head at lower pressures becomes the second factor, namely, the factor of stream diffusion when the stream is flowing through the air without being interrupted by the drive spoon.

Prior art sprinkler heads have been provided with elements for engaging the stream outwardly of the position of spoon engagement when the spoon is out of stream engagement for the purpose of modifying the characteristics of the stream. One configuration of stream engaging element of the type mentioned is in the form of a pin or conically ended fastener adjustably mounted for projection within the stream, the axis of the pin or fastener extending horizontally. Examples of patents disclosing stream engaging pin elements of this type include U.S. Pat. Nos. 3,669,353 and 3,765,608. While these adjustable pin diffusing elements serve to break up the spray, the configuration of the spray after being broken up is not as desirable as a horizontally fanned fan-shaped spray. A second type of stream engaging element which has been utilized in the prior art is a stream engaging baffle. Examples of patents disclosing arrangements of this type are found in U.S. Pat. Nos. 2,654,635; 3,070,314 and 3,837,576. While these baffles tend to diffuse the stream into a fan-shaped spray which is fanned out horizontally, the resultant spray clearly limits the extent of the spray pattern and indeed, these baffle elements are provided for the very purpose of enabling the operator to adjust the extent of the outer periphery of the sprinkler head pattern. In all cases, the baffle element is formed with a stream engaging surface which faces downwardly and inwardly so as to engage an upper portion of the stream so that the fan-shaped spray flows in a downwardly and outwardly extending direction after disengagement therefrom. The outer reaches of the spray disengagement therefrom. The outer reaches of the spray pattern are determined precisely by the extent of the downward inclination of the spray flow after it leaves the baffle.

Where sprinkler heads are operated at relatively low operating pressures within an agricultural irrigation system, it is undesirable to lessen the extent of the water pattern any further, as is the case with the prior art baffle elements, since the pattern area already is reduced as a result of the reduced operating pressure. Consequently, for purposes of enabling sprinkler heads to operate at low pressures within agricultural irrigation sprinkler systems, it is desirable to both diffuse the stream into a fan-shaped spray fanned out horizontally and to maintain the maximum extent of outward water movement.

It is an object of the present invention to accomplish the results noted above. In accordance with the principles of the present invention, this objective is achieved by providing a stream diffusing assembly which includes a stream engaging element having upwardly and inwardly facing stream engaging surface means disposed in a position to engage a lower portion of the cylindrical water stream issuing from the sprinkler body outlet nozzle when the spoon is out of engagement therewith such that the fan-shaped spray flows in an upwardly and outwardly extending direction after disengagement therefrom thus insuring both the desirable shape and extent of the diffused spray.

Preferably, the stream diffusing means includes a pair of upper and lower spaced stream engaging plates, the lower one of which defines the aforesaid upwardly and inwardly facing spray directing surfaces. The upper plate includes a surface inclined with respect to the axis of the stream which is symmetrical with the inclination of the aforesaid surface, the cooperation of two surfaces with respect to one another forming the fan-shaped spray from the cylindrical stream. Preferably, the two plates are adjustably pivotally mounted toward and away from one another so as to change their relative inclinations and spacings while retaining the symmetrical relationship therebetween.

Another object of the present invention is the provision of an improved step-by-step rotary sprinkler head of the type described which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings:

FIG. 1 is a vertical sectional view of a step-by-step rotary sprinkler head embodying the principles of the present invention;

FIG. 2 is an enlarged fragmentary sectional view taken along the line 2—2 of FIG. 1 with the spoon being illustrated in phantom lines;

Figure 4:
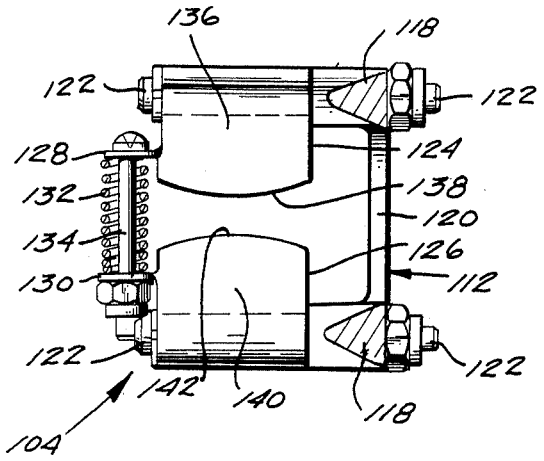
FIG. 4 is a fragmentary sectional view taken along the line 4—4 of FIG. 3.
Figure 3:
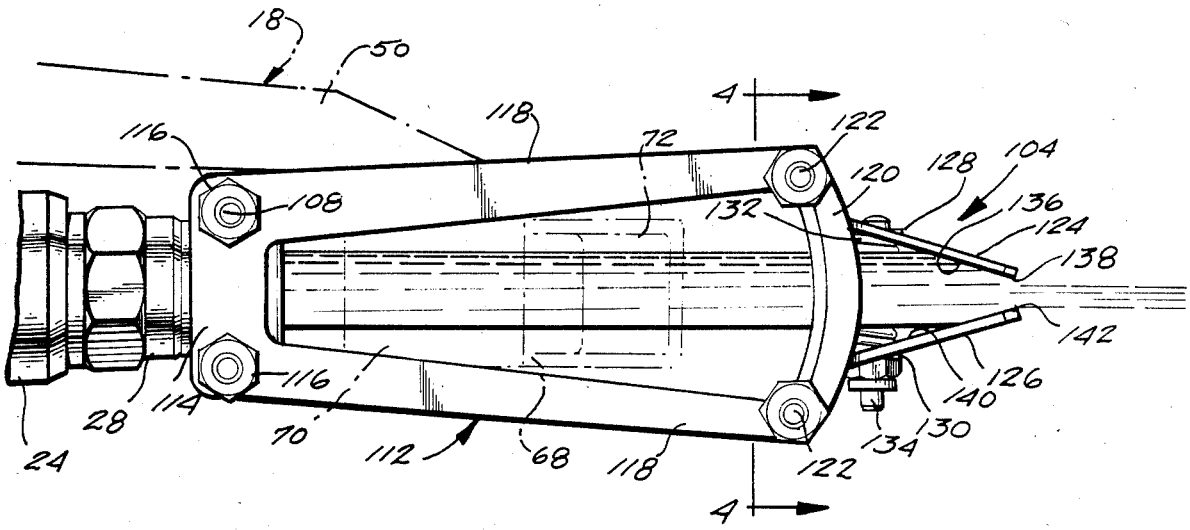
FIG. 3 is a side elevational view of the structure shown in FIG. 2 viewed as indicated by the line 3—3.

Referring now more particularly to the drawings, there is shown therein a step-by-step sprinkler head, generally indicated at 10, which embodies the principles of the present invention. Each improved sprinkler head 10 includes a sprinkler body assembly 12 and a bearing and seal assembly 14 for connecting the sprinkler body assembly in communicating relation with a riser pipe or the like 16 which, in turn, is communicated with a source of water under pressure. The bearing and seal assembly 14 also serves to support the sprinkler body assembly 12 for rotational movement about an upright or vertical axis.

The sprinkler head 10 also includes an impulse arm mechanism, generally indicated at 18, which is operable, when the sprinkler body assembly 12 is communicated through the bearing and seal assembly 14 with a source of water under pressure, to effect a step-by-step rotary movement of the sprinkler body assembly about its rotational axis in one direction.

Referring now more particularly to FIG. 1, the sprinkler body assembly 12 includes a main casting or body having a lower inlet portion 20 defining a water inlet passage 22 therein. Extending upwardly and outwardly from the inlet portion 20 at an angle of approximately 25° with respect to the vertical is an outlet portion 24 having a water outlet passage 26 therein which communicates at its lower end with the inlet passage 22 and at its outer end with a nozzle member 28 threadedly engaged within the outer end of the outlet portion 24.

The bearing and seal assembly 14 includes an inner tubular member 30 having its upper end exteriorly threaded, as indicated at 32, to engage interior threads formed on the lower end of the inlet portion 20 of the sprinkler body assembly 12. The lower end of the tubular member 30 is provided with an annular flange 34 which extends radially outwardly therefrom. Journalled on the central outer peripheral portion of the tubular member 30 is a riser pipe connecting member 36, the lower outer periphery of which is threaded, as indicated at 38, for engagement within cooperating interior threads formed in the upper end of the riser pipe 16.

A lower seal assembly in the form of a pair of outer rubber washers 40 and an inner Teflon washer 42 is mounted on the inner tubular member 30 between the annular flange 34 thereof and the lower end of the member 36. A coil spring 44 mounted in surrounding relation to the upper end of the inner tubular member 30 between the lower end of the sprinkler body inlet portion 20 and the upper end of the member 36 serves to resiliently maintain the washers 40 and 42 in engagement between the members 30 and 36. Preferably, an upper sealing assembly including an upper rubber washer 46 and a lower Teflon washer 48 is mounted between the lower end of the spring 44 and the upper end of the member 36.

It can be seen that the member 36 is thus fixedly supported on the upper end of the riser pipe 16 and the sprinkler body assembly 12 is rotatably supported within the member 36 by virtue of its fixed connection with the tubular member 30. The spring 44 and sealing washers 40, 42, 46 and 48 provide a controlled frictional resistance to the rotation of the sprinkler body and at the same time effectively seal the water under pressure flowing from the riser pipe 16 through the tubular member 30 and into the sprinkler body 12.

As shown, the impulse arm mechanism 18 is of generally conventional construction and includes an arm structure 50 having a cylindrical portion 52 extending upwardly from the central portion thereof which is formed with a throughbore 54, to receive a shaft or pin 56. The pin 56 has its lower end fixedly engaged within a bore 58 formed in the upper central portion of the sprinkler head body 12 to thus support the impulse arm 50 for pivotal movement about the axis of the pin. As shown, the axis of the pin 50 is coincident with the axis of the inlet passage 22 and the axis of rotation of the sprinkler body assembly 12.

Extending upwardly from the upper outer end of the outlet portion 24 is an integral impact portion 60 which is adapted to be engaged by an adjacent portion of the impulse arm 50. The impact portion 60 has an integral pin mounting portion 62 extending horizontally from the upper end thereof which is centrally apertured, as at 64, to receive the upper end of the mounting pin 56. A coil spring 66 is mounted in surrounding relation to the cylindrical portion 52 of the impulse arm 50 and has its upper end connected to the mounting portion 62 and its lower end connected with the central portion of the impulse arm 50 so as to resiliently bias the impulse arm in a direction to maintain the arm in engagement with the impact portion 60.

The end of the impulse arm adjacent the outlet nozzle 28 is provided with a stream engaging spoon or reactant element, indicated at 68. The spoon includes an inner portion 70 having a stream engaging surface which is disposed in a direction such that when the stream impinges thereon the reaction force of the stream acts in a direction to move the impulse arm into engagement with the impact portion 60. The stream engaging surface of the inner portion 70 is inclined in a direction to direct the stream engaged thereby to a generally oppositely facing outer stream engaging surface provided on a spaced outer portion 72 which is shaped and positioned so that when the stream engages the same, the reaction force thereon will act in a direction to move the impulse arm 50 away from the impact portion 60.

The operation of the impulse arm mechanism 18 is conventional in nature. Briefly, it can be seen that since the reaction force acting on the outer portion 72 acts through a greater lever arm than the reaction force on the inner portion 70, the impulse arm 50 will be moved about its axis in a direction away from the impact portion 60. During this impulse movement, the spring 66 is stressed until the pivotal movement of the impact arm is completely arrested at which time the spring 66 serves to effect a pivotal movement of the impulse arm in a direction toward the impact portion 60. During the latter portion of this return movement the stream issuing from the nozzle 28 will first engage the inner portion 70 which acts in a direction to move the impulse arm in a direction to engage the latter with the impact portion 60. When the impulse arm 50 impacts or engages the impact portion 60, the sprinkler head assembly will be moved incrementally a predetermined arcuate distance under the frictional control of the bearing and seal assembly 14.

In accordance with conventional practice, the opposite end of the impulse arm 50 is provided with a counterbalancing portion 74 which is of a shape and size to provide both weight and wind resistance balance to the impulse arm.

The construction of the sprinkler head 10 thusfar described is of a conventional nature and it will be understood that other known constructions may be utilized and that the sprinkler head may be of the impulse type, rather than of the impact type as described. Examples of sprinklers of the impulse type are disclosed in U.S. Pat. Nos. 3,744,720 and 4,153,202. Moreover, the sprinkler head may be provided with part circle capability if desired.

As previously indicated, the present invention is particularly concerned with improvements in step-by-step rotary sprinkler heads of the type described which will serve to break up the stream issuing from the outlet nozzle when the drive spoon is out of engagement with the stream into a desirable fan-shaped spray fanned out horizontally which is directed upwardly and outwardly so as to achieve a maximum ground pattern coverage. As shown, the improvement is in the form of a diffusing assembly, generally indicated at 104, adapted to be attached to the nozzle 28 of the sprinkler head 10. As shown, the exterior periphery of the nozzle 28 is formed with an annular groove 106. The annular groove is adapted to receive the bight portion of a U-shaped bolt 108, the threaded legs of which extend through a pair of openings 110 formed in a mounting bracket, generally indicated at 112. The mounting bracket includes a base portion 114 through which the openings 110 extend and against which nuts 116 threaded on the ends of the U-bolt 108 are tightened to fixedly secure the mounting bracket base 114 alongside the nozzle 28.

The mounting bracket 112 includes a pair of outwardly diverging arm portions 118, the outer ends of which are connected by an outwardly bowed connecting portion 120. Fixed within the outer end of each arm 118 is a shaft 122 which extends horizontally therefrom in a direction generally transverse to the direction of the cylindrical water stream issuing from the nozzle 28. Pivoted to the shafts 122 are a pair of upper and lower stream diffusing plate elements 124 and 126. Upper plate element 124 is provided with a laterally extending integral apertured tab 128 and the lower plate element 126 is formed with a similar apertured tab 130. A coil spring 132 is disposed between the apertured tabs 128 and 130 which serves to resiliently bias the upper and lower plate elements 124 and 126 away from one another. An adjustable bolt assembly 134 extends through the apertured tabs 128 and 130 and the coil spring disposed therebetween and serves to adjustably retain the plates in different spaced apart positions of adjustment with respect to one another.

The upper plate element 124 includes a downwardly and inwardly facing stream engaging surface 136 which terminates outwardly in an arcuate edge 138. The lower plate element 126 includes an upwardly and inwardly facing stream engaging surface 140 which terminates outwardly in an arcuate edge 142 having a configuration similar to that of the edge 138. It will be noted that the arrangement is such that the stream engaging surfaces 136 and 140 of the plate elements 124 and 126 respectively are disposed symmetrically with respect to the axis of the cylindrical stream issuing from the nozzle 28. Moreover, the spring and bolt adjustment provided insures that the symmetrical relationship is retained in any position of adjustment within the range provided. It will be noted that the downwardly and inwardly facing stream engaging surface 136 of the upper plate element 124 engages an upper portion of the cylindrical stream while the upwardly and inwardly facing stream engaging surface 140 of the lower plate element 126 engages a lower portion of the cylindrical stream. The inclination of the stream engaging surfaces 136 and 140 and the arcuate configuration of the outer edges 138 and 142 thereof diffuse the cylindrical stream into a fan-shaped spray which is fanned out horizontally and which is directed in an upward and outward direction as it disengages from the stream engaging diffusing surfaces and leaves the curved edges thereof. The upward and outward direction of the fan-shaped spray is generally the same as the upward and outward direction of the cylindrical water stream issuing from the nozzle 28.

It will also be noted that the spacing of the arm portions 118 and the position of the connecting portion 120 of the mounting bracket 112 is such as to provide minimum interference with the water issuing from the end of the drive spoon 68 when the latter is in a position to be engaged by the stream issuing from the nozzle 28.

While the diffusing assembly has been disclosed as constituting an improvement in step-by-step rotary sprinkler heads, it will be understood that the structural and functional principles embodied in the diffusing assembly 104 may also be conveniently used on sprinklers other than the step-by-step rotary type, such as electrical drive rotary sprinklers, water motor-gear driven rotary sprinklers and even as an attachment for the nozzle of a fixed sprinkler head.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A step-by-step rotary head comprising a sprinkler body having an inlet and at least one outlet communicating with said inlet, means mounting said sprinkler body for rotational movement about a generally vertical axis and for communicating the inlet of said sprinkler body with a source of water under pressure, nozzle means in said at least one outlet for directing water under pressure communicated with said inlet outwardly of said nozzle means in a cylindrical water stream flowing in an upward and outward direction, means mounted for rotational movement with said sprinkler body and for cyclical movements with respect thereto between a position of stream engagement and a spaced position out of stream engagement for effecting step-by-step rotational movements of said sprinkler body in conjunction with said cyclical movements, and stream diffusing means disposed outwardly of the position of stream engagement of said step-by-step movement effecting means for engaging the cylindrical water stream when the latter is out of said position of stream engagement and diffusing said cylindrical water stream into a fan-shaped spray which is fanned out in a generally horizontal direction, said stream diffusing means including a pair of vertically spaced upper and lower stream engaging plates, the lower of said stream engaging plates providing an upwardly and inwardly facing stream engaging surface means disposed in a position to engage a lower portion of the cylindrical water stream so that said fan-shaped spray flows in an upwardly and outwardly extending direction after disengagement therefrom.

2. A sprinkler head as defined in claim 1 wherein said upwardly and inwardly facing stream engaging surface means comprises a stream engaging surface on said lower plate which terminates outwardly in an outwardly bowed arcuate edge.

3. A sprinkler head as defined in claim 2 wherein said upper plate includes a downwardly and inwardly facing stream engaging surface arranged symmetrically with respect to the upwardly and inwardly facing stream engaging surface of said lower plate in relation to the axis of said cylindrical water stream.

4. A sprinkler head as defined in claim 3 wherein said downwardly and inwardly facing stream engaging surface terminates outwardly in an outwardly bowed arcuate edge symmetrical to said first mentioned outwardly bowed arcuate edge.

5. A sprinkler head as defined in claim 4 wherein said stream diffusing means includes means for adjustably varying the spacing between said plates while maintaining the symmetrical relationship between the stream engaging surfaces thereof.

6. A sprinkler head as defined in claim 5 wherein said adjusting means comprises means mounting said plates for pivotal movement about parallel vertically spaced axes, spring means for resiliently biasing said plates apart and bolt means for adjustably limiting the spaced apart position into which said plates are biased by said spring means.

7. A sprinkler head as defined in claim 6 wherein said adjusting means further includes apertured tabs extending laterally from said plates through which said bolt means extend.

8. A sprinkler head as defined in claim 7 wherein said spring means comprises a coil spring surrounding said bolt means between said apertured tabs.

9. A sprinkler head as defined in claim 6 wherein said mounting means comprises a mounting bracket having a base portion fixed to said nozzle means by a U-bolt assembly, a pair of arm portions diverging outwardly from said base portion and a connecting portion extending between the outer ends of said arm portion.

* * * * *